US005816783A

United States Patent [19]

Oshima et al.

[11] Patent Number: 5,816,783

[45] Date of Patent: Oct. 6, 1998

[54] ELECTRICALLY DRIVEN HERMETIC COMPRESSOR

[75] Inventors: Yasuhiro Oshima, Tochigi-ken; Kenji Ogino, Sano; Hiromasa Uchida, Kiryu; Mitsuji Yamamoto, Ashikaga; Kazuhiro Suzuki; Hiroyasu Owada, both of Tochigi-ken, all of Japan

[73] Assignee: Hitachi, Ltd., Japan

[21] Appl. No.: 842,086

[22] Filed: Apr. 28, 1997

Related U.S. Application Data

[63] Continuation-in-part of Ser. No. 651,507, May 22, 1996, abandoned, which is a continuation of Ser. No. 243,177, May 16, 1994, abandoned.

[30] Foreign Application Priority Data

May 19, 1993 [JP] Japan ..... 5-116707

[51] Int. Cl.[6] ..... F04B 17/00

[52] U.S. Cl. ..... 417/415; 417/562; 417/902

[58] Field of Search ..... 417/562, 565, 417/902, 415, 571

[56] References Cited

U.S. PATENT DOCUMENTS

| | | | |
|---|---|---|---|
| 2,025,240 | 12/1935 | Higham | 417/571 |
| 2,984,408 | 5/1961 | Nicholas | 417/562 |
| 3,229,901 | 1/1966 | Parker | 417/902 X |
| 3,233,822 | 2/1966 | Comstock et al. | 417/902 X |
| 4,573,880 | 3/1986 | Hirano et al. | 417/902 X |
| 4,834,631 | 5/1989 | Schrank et al. | 417/571 X |

FOREIGN PATENT DOCUMENTS

| | | |
|---|---|---|
| 63-119880 | 8/1988 | Japan . |
| 2-132881 | 5/1990 | Japan . |
| 4-125681 | 11/1992 | Japan . |

*Primary Examiner*—Timothy Thorpe
*Assistant Examiner*—Cheryl J. Tyler
*Attorney, Agent, or Firm*—Evenson, McKeown, Edwards & Lenahan, P.L.L.C.

[57] ABSTRACT

An electrically driven hermetic compressor comprises a hermetic casing, an electric motor unit encased in the casing, and a compression mechanism encased by the casing and drivingly connected to the electric motor unit through a crankshaft. The compression mechanism includes a cylinder, a piston reciprocatingly slidable in the cylinder, a valve plate having formed therein a suction port and a discharge port and providing valve seats around the ports, suction valve and a discharge valve cooperating with the suction and discharge ports. The cylinder, the piston and the valve plate cooperate to define a compression chamber. The compressor further has a passage system providing separate passages for a gas to be compressed and the gas after compression, and a motion converting mechanism for converting rotary motion of the crankshaft into linear reciprocating motion of the piston. A frusto-conical projection is formed on the top of the piston at a point offset from the axis of the piston so as to be receivable in the discharge port which also is offset from the axis of the piston, thus minimizing dead volume when the piston has reached its top dead center of its stroke.

3 Claims, 7 Drawing Sheets

REFREGIRANT

OIL

MIST OIL

ELECTRICALLY DRIVEN HERMETIC COMPRESSOR

This application is a continuation-in-part of application Ser. No. 08/651,507 filed May 22, 1996 abandoned which is a continuation of application Ser. No. 08/243,177, filed on May 16, 1994 abandoned.

BACKGROUND OF THE INVENTION

1. Field of the Invention

The present invention relates to an electrically driven hermetic compressor and, more particularly, to an electrically driven hermetic compressor which operates at high compression efficiency and which has improved durability. The compressor of the present invention is particularly suitable for use in a refrigerator, as well as airconditioning refrigerator, which operates with a refrigerant free of chlorine, e.g., HFC 134a.

2. Description of the Prior Art

A conventional electrically driven hermetic reciprocating compressor has, as shown in Japanese Unexamination Utility Model Publication No. 2-132881, for example, a projection which is formed on the top of a piston so as to move into a discharge port in a valve seat plate so as to reduce dead space, thereby increasing the compression efficiency. The projection has a cylindrical or frusto-conical form which is coaxial with the piston or a ring-like form concentric with the piston.

Known electrically driven hermetic compressors will be described with reference to FIGS. 8 and 9. FIG. 8 is a cross-sectional view of a known electrically driven hermetic compressor showing particularly a critical portion of the compressor, while FIG. 9 is a sectional view of a critical portion of another known electrically driven hermetic compressor.

Referring first to FIG. 8, the compressor has a crankshaft 1, a piston 2, a piston rod 3A, a cylinder 4, a valve seat plate 5, a discharge port 6, a suction port 7, a cover 18, a suction silencer passage 18*a*, a discharge chamber 18*b* and a discharge passage 18*c*.

As will be seen from the drawings, the compressor employs a ball-joint type connection between the piston 2 and the piston rod 3A, serving as means for converting rotary motion of the crankshaft 1 into straight reciprocating motion of the piston 2. When this type of joint is used, the piston 2 is allowed to rotate about its longitudinal axis which passes the center of the ball of the joint. Even if the compressor is designed such that the projection 2*a* on the piston and the discharge port 6 in the valve seat plate 5 are offset from the center of the piston 2, the projection 2*a* is undesirably shifted in the circumferential direction out of alignment with the discharge port as a result of rotation of the piston 2, with the result that the crankshaft is prevented from rotating due to interference between the thus shifted piston projection 2*a* and a portion of the cylinder head or the valve seat plate. This is the reason why the projection 2*a* on the piston has to be provided concentrically with the piston 2.

FIG. 9 shows the known compressor of the type disclosed in Japanese Unexamined Utility Model Publication No. 2-132881. This compressor has a projection 2*c* formed on the center of the piston 2A. In this type of compressor, a large sealing distance is required to isolate the suction port 7A and the discharge port 6A from each other, so that the area of the suction port 7A is reduced to disadvantageously increase the suction resistance.

This problem can be overcome by dual arrangement of suction port 7A as illustrated in FIG. 9. The provision of two suction ports, however, requires complicated configuration of suction passages and increased thickness of the vale seat plate 5A in order to obtain required strength.

SUMMARY OF THE INVENTION

An object of the present invention is to provide an electrically driven hermetic compressor in which minimization of dead volume is achieved by a projection provided on the piston top without being accompanied by problems such as complication in the suction and discharge passages, so as to improve compression efficiency by reduction of loss and reduction in the capacity due to re-expansion of the compressed gas, thereby overcoming the above-described problems of the prior art.

According to one aspect of the present invention, there is provided an electrically driven hermetic compressor, comprising:

a hermetic casing;

an electric motor unit encased in said casing; and a compression mechanism encased by said casing and drivingly connected to said electric motor unit through a crankshaft;

said compression mechanism comprising a cylinder, a piston reciprocatingly slidable in said cylinder, a valve plate having formed therein a suction port and a discharge port and providing valve seats around said ports, suction and discharge valves cooperating with said suction and discharge ports, said cylinder, said piston and said valve plate cooperating to define a compression chamber, a passage system providing separate passages for a gas to be compressed and the gas after compression, and a motion converting mechanism for converting rotary motion of said crankshaft into linear reciprocating motion of said piston, wherein a projection is formed on the top of said piston at a point offset from the axis of said piston so as to be received in said discharge port formed in said valve plate.

The projection on the top of the piston may have a frusto-conical shape and the discharge port may also be conically shaped, the gradient of the conical surface of the projection being smaller than that of the discharge port.

The motion converting mechanism may be of a scotch-yoke-type mechanism having a slide tube integral with the piston and a slider connected to the eccentric portion of the crankshaft and reciprocatingly slidable in the slide tube. The suction port formed in the valve plate is offset from the axis of the cylinder towards a pressing portion of the piston which applies pressure to the wall of the cylinder due to inclination of the piston with respect to the axis of the cylinder. The projection on the top of the piston is offset from the axis of the piston in the direction opposite to the pressing portion of the piston.

In the electrically driven hermetic compressor having the described features, the projection on the top of the piston and the discharge portion in the valve plate are offset from the axis of the piston, so that a sufficiently large sealing distance is obtained between the suction and discharge passages. In addition, the suction and discharge ports can have ample cross-sectional areas despite the provision of the projection on the top of the piston.

The above and other objects, features and advantages of the present invention will become more apparent from the following description with reference to the accompanying drawings.

DESCRIPTION OF THE PREFERRED EMBODIMENTS

The basic concept of the present invention will be described with reference to FIG. 1 which is a sectional view of an embodiment of the electrically driven hermetic compressor of the present invention, showing particularly a critical portion of the compression mechanism section.

Figure 1:
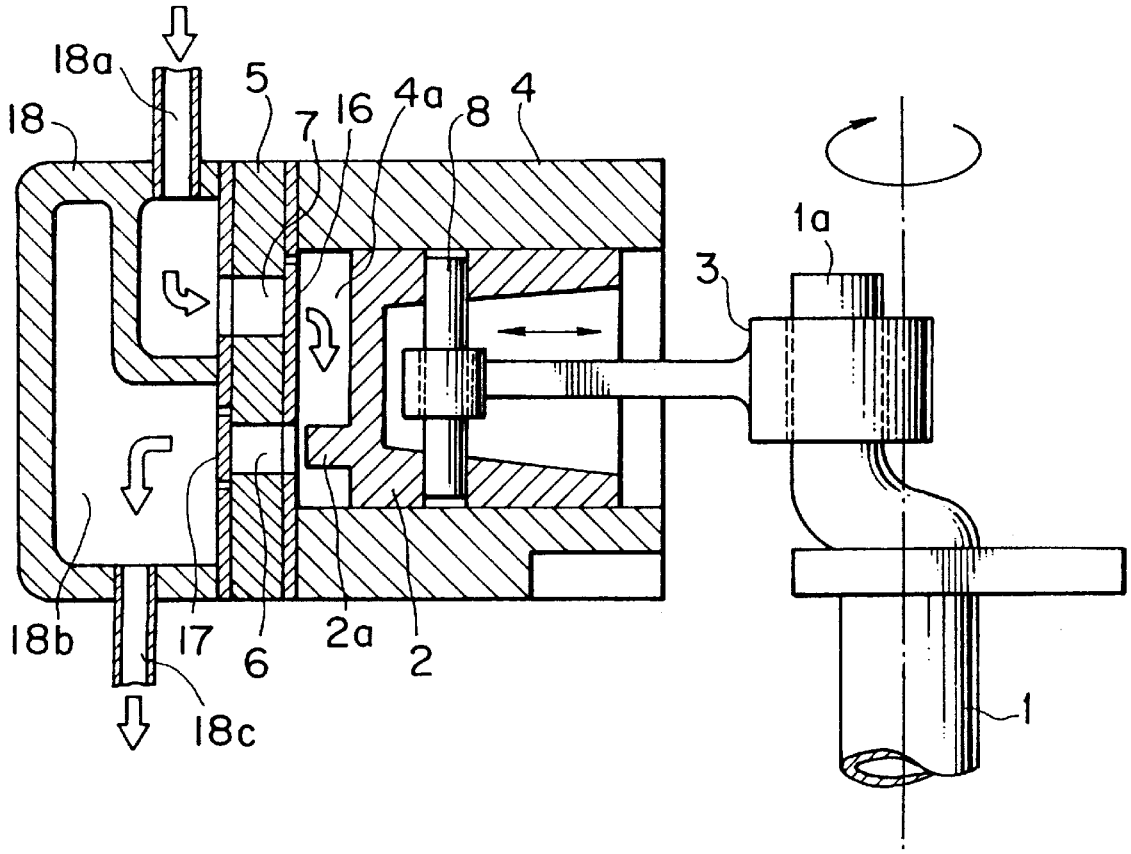
FIG. 1 is a sectional view of an embodiment of an electrically driven hermetic compressor of the present invention, showing particularly a critical portion of a compression mechanism section thereof.

In FIG. 1, the electrically driven hermetic compressor embodying the present invention has a connecting rod-type mechanism as means for converting rotary motion of the crankshaft 1 into linear or straight reciprocating motion of the piston 2. This connecting mechanism employs a pin 8 which pivotally connects the rod 3 to the piston 2 and which serves to prevent the piston 2 from rotating about the axis thereof, i.e., the axis of a cylinder 4 which slidably receives the piston 2. The piston 2 has a projection 2*a* formed on the top thereof. The projection 2*a* is adapted to be received in the discharge port 6 when the piston 2 is near the top dead center of its stroke. Taking into consideration the play between the pin 8 and the rod 3, the projection 2*a* and, accordingly, the discharge port 6 are offset from the center of the piston. According to this arrangement, mis-alignment between the projection 2*a* and the discharge port 6 due to, for example, rotation of the piston 2 does not occur so that the crankshaft can be rotated without being hampered by interference between the piston and the cylinder head which otherwise may be caused by the rotation of the piston 2 about its own axis. Since the discharging port 6 is offset from the center of the piston, it is possible to obtain a large sealing distance between the suction and discharge passages, as well as large cross-sectional areas of the suction and discharge ports.

Thus, the present invention realizes minimization of the dead volume which is the purpose of the provision of the projection on the piston top, without being accompanied by problems such as limitation in the cross-sectional areas of the suction and discharge ports, thus reducing loss of power and reduction in the capacity due to re-expansion of compressed gas, thereby improving efficiency of the compressor.

Embodiments of the present invention will be described with reference to FIGS. 1 to 7.

(First Embodiment)

Figure 2:
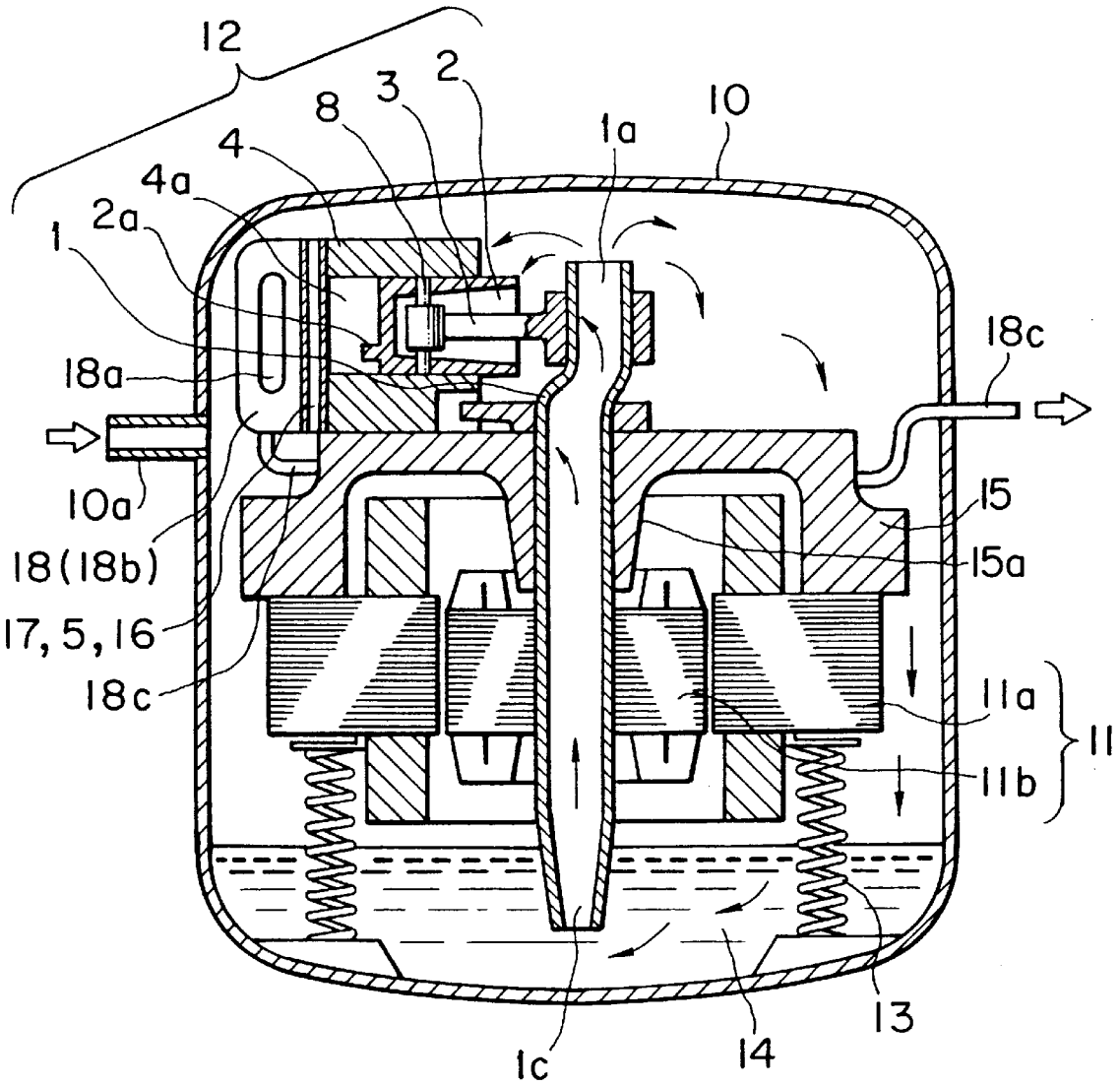
FIG. 2 is a vertical sectional view of the compressor shown in FIG. 1.
Figure 3:
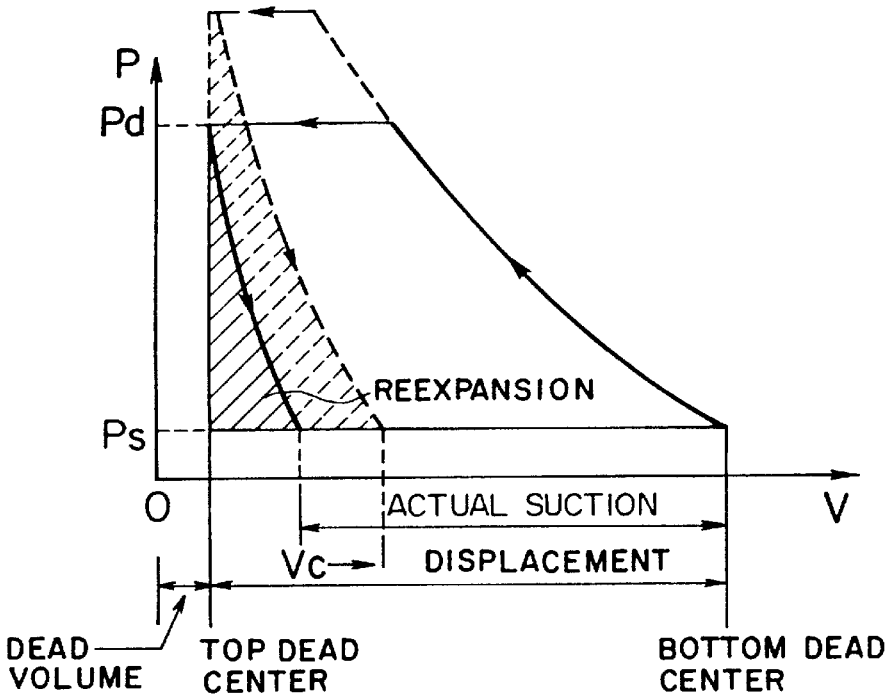
FIG. 3 is a pressure-volume diagram illustrating the performance of the compressor shown in FIG. 2.
Figure 8:
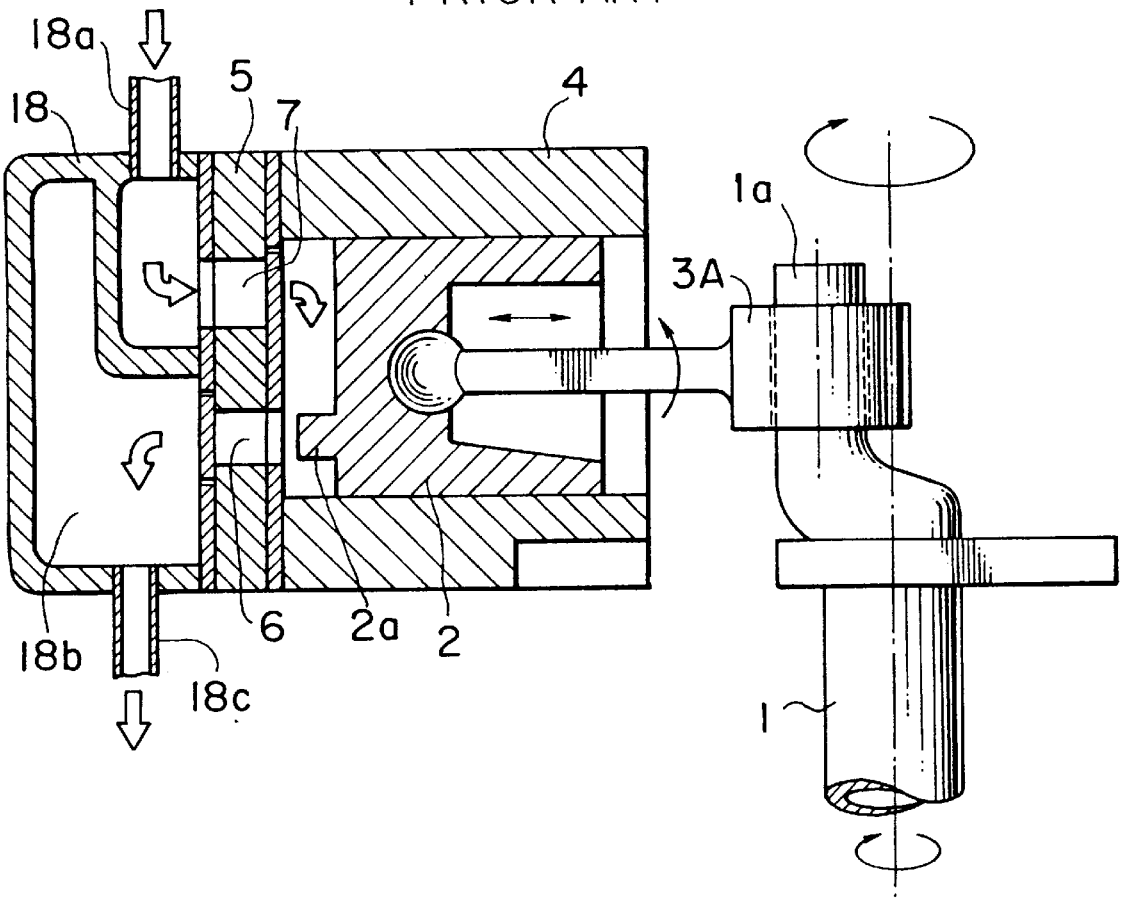
FIG. 8 PRIOR ART
FIG. 8 is a sectional view of a critical portion of a compression mechanism in a known electrically driven hermetic compressor.
Figure 9:
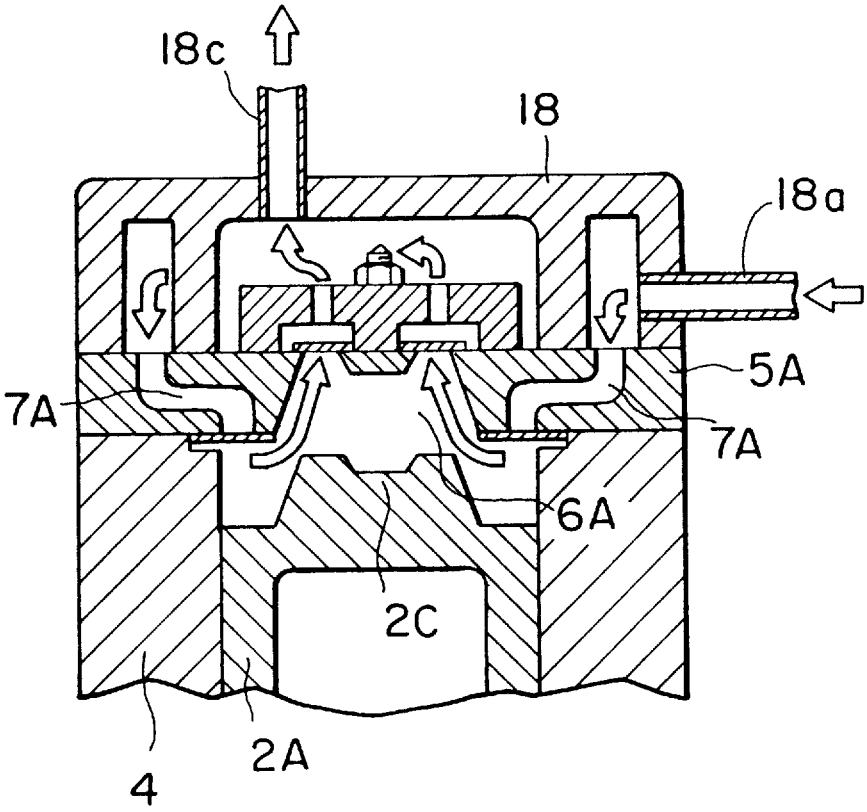
FIG. 9 PRIOR ART
FIG. 9 is a sectional view of a critical portion of a compression mechanism in another known electrically driven.

FIG. 2 is a vertical sectional view of an electrically driven hermetic compressor as an embodiment of the present invention, while FIG. 3 is a pressure-volume diagram showing the operation characteristics of the compressor shown in FIG. 2. The compressor of FIG. 2 incorporates a compression mechanism which has been described in connection with FIG. 1. In FIGS. 1 and 2, parts or components which are the same as those of the known compressor shown in FIG. 8 are denoted by the same reference numerals appearing in FIG. 8.

The electrically driven hermetic compressor shown in FIG. 2 has a hermetic casing 10 which encases an electric motor unit 11 and a compression mechanism 12 which are connected to each other by crankshaft 1. The assembly compressed of the electric motor unit 11 and the compressor mechanism 12 is supported by the bottom of the casing through elastic supporting means such as springs 13.

A lubricating oil 14 is reserved in an oil pan formed on the bottom of the casing 10. The crankshaft 1 has an axial bore 1*c* serving as an il passage bore and extends into the oil pan such that the lower end of the bore 1*c* opens in the lubricating oil 14 in the oil pan. In operation, the lubricating oil 14 is sucked through the oil passage bore 1*c* by the suction force which is created by centrifugal force generated as a result of rotation of the crankshaft 1, so that a part of the lubricating oil is supplied to a frame bearing 15*a* and an eccentric portion 1*a* of the crankshaft 1. The lubricating oil 14 also is sprayed to form an oil mist in a space around and above the crankshaft 1 so as to lubricate other parts such as the outer surface of the piston 2.

The electric motor unit 11 has a stator 11*a* fixed to a frame 15 by means of bolts (not shown) and a rotor 11*b* which is fixed to the crankshaft 1 by shrink fit. The above-mentioned frame bearing 15*a* is connected to the frame 15 so as to rotatably support the crankshaft 1.

The compression mechanism 12 has, as shown in FIGS. 1 and 2, a cylinder 4, a piston 2 slidably received in the cylinder 4 for reciprocating motion, and a valve plate 5 having formed therein a suction port 7 and a discharge port 6. A compression chamber 4*a* is defined by the cylinder 4, piston 2 and the valve plate 5. The compression mechanism 12 also have suction and discharge passages separated from each other and connected to the suction and discharge ports 7,6, respectively.

A mechanism is provided for converting the rotary motion of the crankshaft 1 into linear reciprocating motion of the piston 2. More specifically, the mechanism includes a connecting rod 3 (referred to simply as "rod") having a bearing portion embracing the eccentric portion 1*a* of the crankshaft 1 and a piston pin 8 by which the rod 3 is pivotally connected to the piston 2. This mechanism converts the rotary motion of the crankshaft 1 into reciprocating linear motion of the piston 2 in a manner known per se.

The valve plate 5, a suction valve 16 and a discharge valve 17 cooperate to form a valve unit on the end of the cylinder 4 opposite to the crankshaft 1. A cover 18 attached to the outer side of the valve plate 5 has a partition wall which separates from each other a suction passage 16 leading from a suction silencer passage 18*a* and a discharge chamber 18*b* leading to a discharge passage 18*c*.

As shown in FIG. 1, the piston 2 is provided on the top thereof with a projection 2*a* which is offset from the center of the piston so as to be received in the discharge port 6 formed in the valve plate 5 when the piston 2 has been moved near to the top dead center of its stroke. Thus, the projection 2*a* on the piston 2 and the discharge port 6 are offset from the axis of the piston 2 so that the compressor operates without interference between the piston projection 2*a* and the valve pate 5. In addition, the offsetting of the discharge port 6 from the axis of the piston 2 provides a large sealing distance between the suction and discharge ports, while making it possible to design the suction and discharge ports with large cross-sectional areas.

The operation of the compression mechanism is as follows: A negative pressure is established in the cylinder 4 as a result of downward stroking, i.e., movement to the right as viewed in FIG. 1, of the piston 2, so that the suction valve 16 is opened. Consequently, a gas to be compressed is introduced into the hermetic casing 10 through the suction pipe 10*a* and is sucked into the compression chamber 4*a* via the suction silencer passage 18*a*, the suction port 7 and the suction valve 16. The piston 2 then commences its upward, i.e., leftward, stroking from the bottom dead center, so that the pressure inside the compression chamber 4*a* is raised to close the suction valve 16. The volume of the compression chamber 4*a* is further reduced to increase the gas pressure. When the gas pressure reaches a predetermined pressure level, the discharge valve 17 is opened so that the gas is relieved into the discharge chamber 18*b* in the cover 18 through the discharge port 6 until the piston 2 reaches the top dead center. The discharged gas is introduced to the exterior of the hermetic casing 10 through the discharge passage 18*c*. The described suction, compression and discharge strokes are cyclically repeated as the crankshaft 1 continuously rotates.

The above-described cyclic operation will be described with reference to FIG. 3 which shows P-V diagram (pressure-volume diagram). The volume of the compression chamber 4*a* is not reduced to zero even when the piston has reached its top dead center. Namely, a certain volume including the volume inside the discharge port remains unchanged even after the piston has reached the top dead center. This volume is generally referred to as "dead volume" which cannot be displaced. Thus, a gas of a discharge pressure Pd remains inside the compression chamber 4*a* without being discharged. This gas makes an adiabatic expansion in the subsequent suction stroking down to a suction pressure Ps. Thus, the suction of the fresh gas is commenced at a point indicted at Vc in FIG. 3, with the result that the actual suction volume is reduced. This re-expansion of the gas undesirably impairs refrigeration power when the compressor is used in a refrigerator and reduces the absolute value of the vacuum achievable when the compressor is used as a vacuum pump.

The work performed by the re-expansion of the gas (work performed by the piston in the preceding compression stroke, hatched area in FIG. 3) is partly recovered as an energy which serves to downwardly urge the piston, thus assisting the work of the electric motor. A part of the work, however, is not recovered and causes a so-called re-expansion loss. Thus, the dead volume not only reduces the capacity (gas discharge rate) of the compressor but also reduces the efficiency of the same. The dead volume therefore should preferably be minimized.

The volume Vc and the re-expansion work are increased when the pressure ratio (Pd in FIG. 3) is large, thus seriously affecting the capacity and efficiency of the compressor. Reduction of the dead volume, therefore, is particularly important in compressors which are incorporated in systems operating with large pressure ratio, such as compressors used in refrigerators and airconditioners.

In a typical refrigerator compressor, the displacement volume is as small as 5 ml and the inside diameter of the cylinder 4 is correspondingly small, e.g., 20 mm or so. Compressors in airconditioners usually have displacement volumes which are as large as 3 to 4 times those of refrigerators but the cylinder inside diameter is as small as 20 mm or so since a pair of cylinders are usually used to improve efficiency while suppressing vibration. It is necessary to arrange a discharge port 6 of 3 to 4 mm diameter and a suction port 7 of 7 to 8 mm diameter within a circle of such a small cylinder inside diameter, while separating both ports from each other by the cover 18 by providing a seal distance of at least 3 to 4 mm. In addition, the vale lift angles of the suction valve 16 and the discharge valve 17 also are limited from the view point of reliability. It has therefore been necessary that the discharge port 6 be offset from the axis of the piston 2.

In this embodiment, the projection 2*a* provided on the top of the piston 2 is offset from the center of the piston 2 correspondingly to the offset of the discharge port 6, taking into account mechanical plays existing between the pin 8 and the rod 3, between the rod 3 and the crankshaft 1, between the crankshaft 1 and the frame 15 and between the piston 2 and the cylinder 4 so that the projection 2*a* is received in the discharge port 6 thereby reducing the volume which is left in the discharge port when the piston has reached the top dead center and which forms one of the major factors of the dead volume, whereby the re-expansion is suppressed to achieve greater capacity and higher efficiency of the hermetic compressor.

As will be understood from the foregoing description, in the first embodiment of the invention, the projection 2*a* on the top of the piston 2 and the discharge port 6 are offset from the axis of the piston, so that a long sealing distance can be preserved and the suction and discharge ports 7, 6 can have sufficiently large cross-sectional areas despite the provision of the projection 2*a*. It is therefore possible to reduce the dead volume in the discharge port 6 while eliminating limitations relating to the suction and discharge passages, thus suppressing loss of energy and reduction of capacity attributable to re-expansion of the compressed gas, whereby the efficiency of the compressor is improved.

A further improvement in the suction efficiency is achievable by designing the suction port 7 such that it has an elongated slit-like form extending towards the axis of the piston.

(Second Embodiment)

Figure 4:
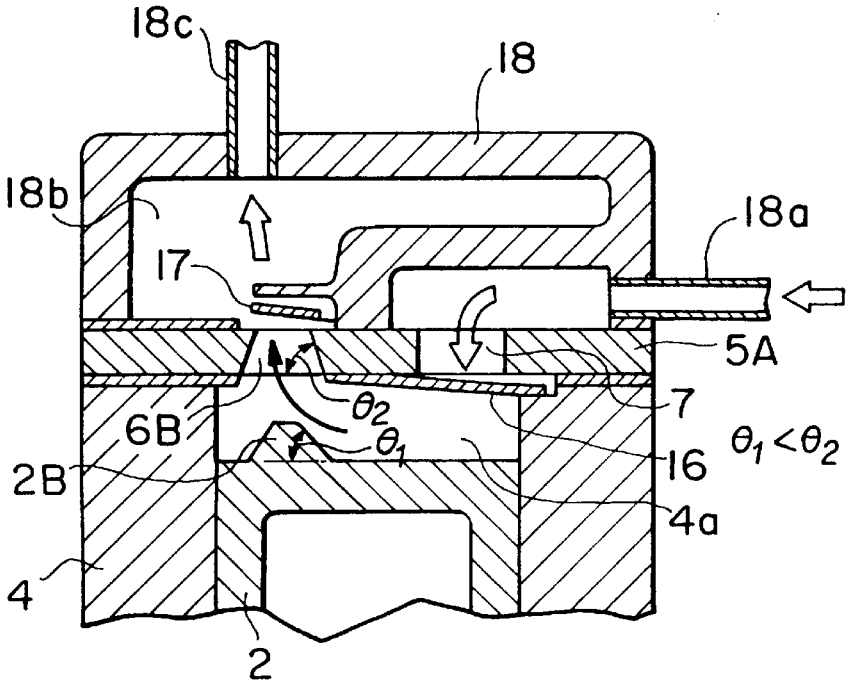
FIG. 4 is a sectional view of another embodiment of the electrically driven hermetic compressor of the present invention, showing particularly a critical portion of a compression mechanism thereto.

FIG. 4 is a vertical sectional view of a critical portion of the compression mechanism in a second embodiment of the electrically driven hermetic compressor of the present invention. Components or parts which are the same as those used in the first embodiment are denoted by the reference numerals same as those appearing in FIG. 1, and detailed description of such components or parts is omitted.

The second embodiment shown in FIG. 4 is different from the first embodiment in that the projection, denoted by 2B, on the top of the piston has a frusto-conical form having a gradient or slope smaller than that of the wall defining the discharge port 6. More specifically, in this embodiment, the projection 2B and the discharge port, denoted by 6B, are offset from the axis of the piston 2. The wall defining the discharge port 6B is conically shaped such that the diameter of the discharge port progressively decreases from the end of the port 6B adjacent the piston towards the end adjacent the discharge chamber 18*b*, and the gradient of the frusto-conical shape of the projection 2B which is to be received in the discharge port 6B is smaller than that of the discharge port 6B.

In general, when the projection on the piston top moves into the discharge port to expel the refrigerant gas from the cylinder, the velocity of the gas which is being discharged becomes excessively high because the cross-sectional area of the discharge passage is reduced, with the result that the gas encounters with increased resistance so as to excessively elevate the pressure inside the cylinder, thus increasing over-compression loss, i.e., wasteful use of energy due to compression of the gas to an unnecessarily high pressure level. Therefore, a too small clearance between the projection on the piston top and the discharge port may undesirably lower the efficiency, thus hampering the advantage which is expected to be derived from the provision of the projection on the top of the piston. Therefore, although there are many points which have to be taken into consideration when the piston projection is offset as described before, such points do not cause any critical problem.

In the embodiment shown in FIG. 4, the projection 2B on the top of the piston has a frusto-conical form and the gradient of the conical surface of the projection 2B is determined to be smaller than that of the discharge port 6B.

This second embodiment offers the same advantages as those provided by the first embodiment described before and an additional advantage that a sufficiently ample discharge area is preserved so as to reduce over-compression. This additional advantage is provided by the fact that the gradient $\theta_1$ of the conical projection 2B is smaller than the gradient $\theta_2$ of the conical discharge port 6B. Where the gradient $\theta_1$ of a conical projection is the same as or greater than the gradient $\theta_2$ of a conical discharge port, the cross-sectional area of the discharge passage defined between the outer peripheral surface of the conical projection and the inner peripheral surface of the conical discharge port is minimum in the section between the outer peripheral edge of the top end of the projection and the inner peripheral surface of the discharge port.

Accordingly, where the gradient $\theta_1$ of the conical projection is the same as or greater than the gradient $\theta_2$ of the conical discharge port, the rate of flow of the compressed fluid through the discharge port is determined by the minimum cross-sectional area of the discharge passage which is defined between the outer peripheral edge of the top of the projection and the inner peripheral surface of the discharge port, with a disadvantageous result that the flow of the compressed fluid through the discharge port encounters with a large resistance with a resultant occurrence of an over-compression in the cylinder and a pressure loss in the discharged fluid. Such disadvantage is avoided by the embodiment shown in FIG. 4 because the gradient $\theta_1$ of the conical projection 2B is made smaller than the gradient $\theta_2$ of the conical discharge port 6B to assure that the cross-sectional area of the discharge passage defined between the outer peripheral edge of the top of the projection 2B and the inner peripheral surface of the discharge port 6B may be substantially the same as the cross-sectional area of the discharge passage defined between the inner peripheral edge of the inlet end of the discharge port 6B and the outer peripheral surface of the projection 2B.

(Third Embodiment)

Figure 5:
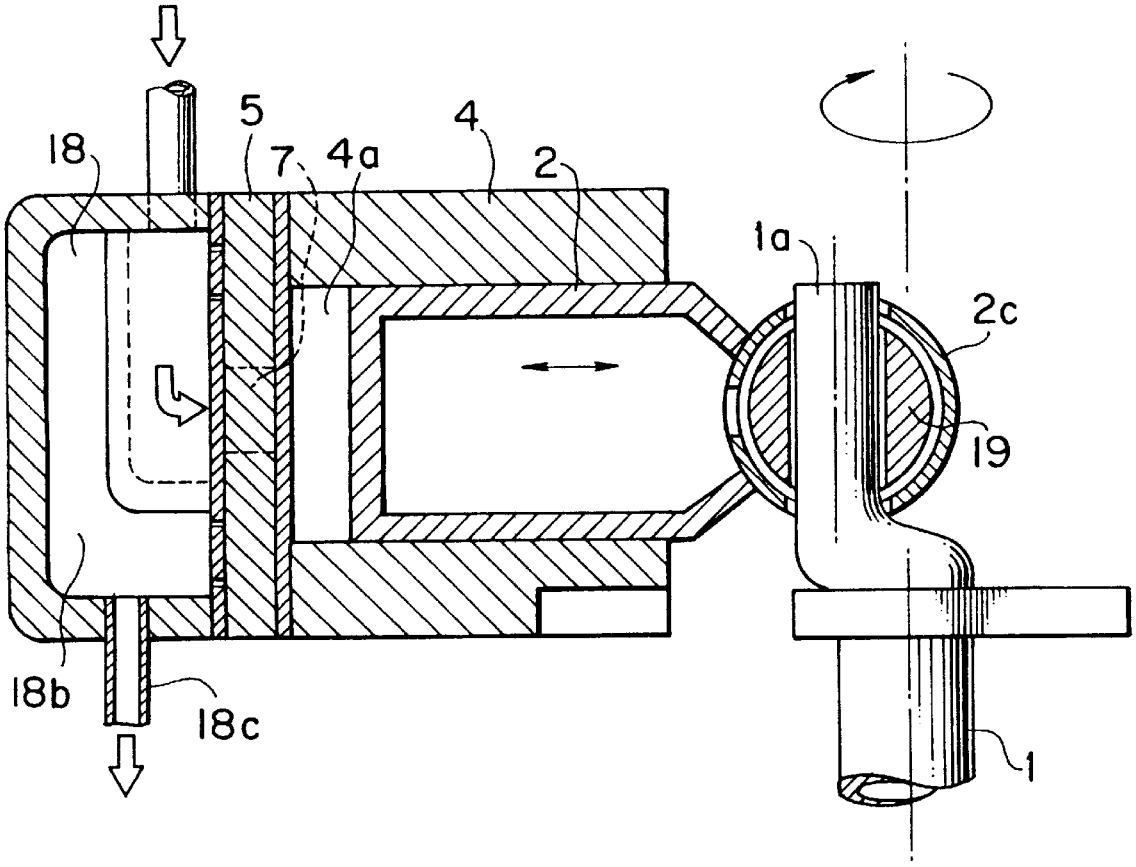
FIG. 5 is a sectional view of still another embodiment of the electrically driven hermetic compressor of the present invention, showing particularly a critical portion of a compression mechanism thereof.

FIG. 5 is a vertical sectional view of a critical portion of the compression mechanism of a third embodiment of the electrically driven hermetic compressor in accordance with the present invention. FIGS. 6A to 6D are views of the compression mechanism shown in FIG. 5, illustrative of suction, compression an discharge strokes performed by the compression mechanism. In these Figures, the same reference numerals as those appearing in FIG. 1 are used to denote the same components or parts as those of the first embodiment and detailed description of such components or parts is omitted.

The compression mechanism shown in FIG. 5 has a slide tube 2*c* integral with the piston 2 and a cylindrical slider 19 which is connected to the eccentric portion 1*a* of the crankshaft 1 and which slides in the slide tube 2*c*. The slide tube 2*c* and the slider 19 in combination form a mechanism known as "scotch-yoke-type mechanism" which converts rotary motion of the crankshaft 1 into linea reciprocating motion of the piston 2.

As in the cases of the first and second embodiments described before, rotation of the piston 2 relative to the cylinder 4 is prevented also in this embodiment, so that the projection 2*a* can be located at an offset from the axis of the piston 2 without any risk of interference between the projection 2*a* and the valve plate.

More specifically, FIGS. 6A to 6D are illustrations of the scotch-yoke-type compression mechanism as viewed from the top of the electrically driven hermetic compressor. Since the slide tube 2*c* is integral with the piston 2, the piston 2 is allowed to incline with respect to the axis of the cylinder 4 within an angular range afforded by the clearance between the piston 2 and the wall of the cylinder 4, during one cycle of the piston operation in which the piston reciprocates between the top dead center (see FIG. 6A) and the bottom dead center (see FIG. 6C) while performing suction stroking (see FIG. 6B) and compression stroking (see FIG. 6D).

Due to the inclination of the piston 2 with respect to the axis of the cylinder 4, the edge 2*d* of the top of the piston 2 is kept in contact with the wall of the cylinder 4 while the portion of the piston 2 diametrically opposite to the edge 2*d* is held in contact with the lower edge 4*b* of the cylinder.

Figure 6A:
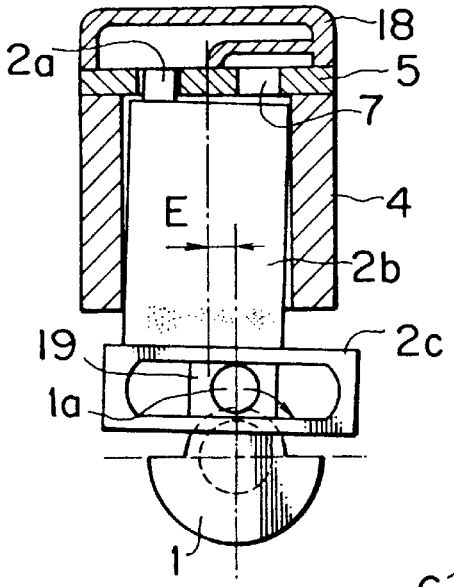
FIGS. 6A to 6D are views of the compression mechanism shown in FIG. 5, illustrating one cycle of operation thereof including suction stroke, compression stroke and discharge stroke.
Figure 6D:
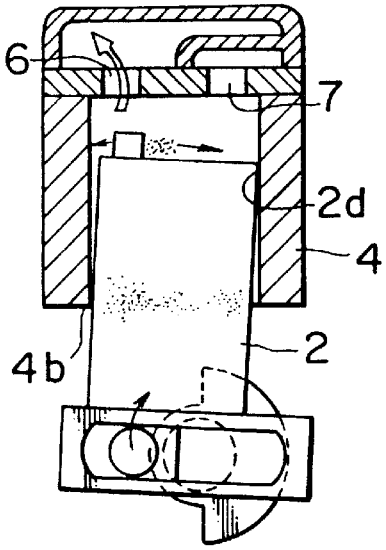
Figure 6B:
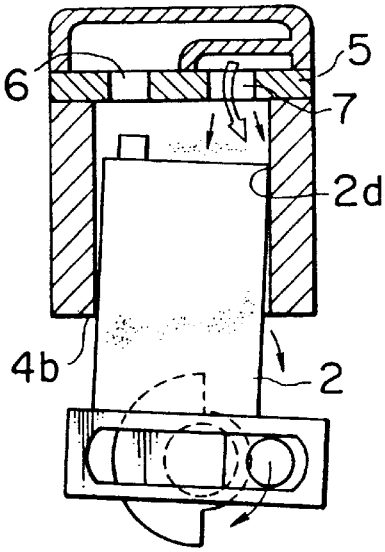
Figure 6C:
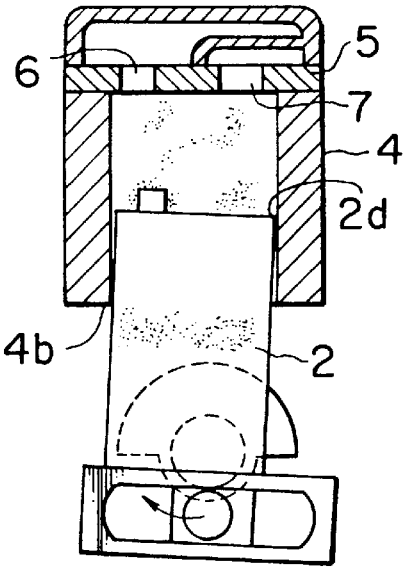

The supply of the lubricating oil to the piston 2 and the cylinder 4 is conducted mainly in two ways: namely, the mist of lubricating oil sprayed from the crankshaft 1 into the space above and around the crankshaft 1 is sucked into the cylinder 4 through the suction passage 18*a* so as to lubricate the region between the edge 2*d* of the piston 2 and the wall of the cylinder 4, while another portion of the oil mist attaches to the outer surface of the piston 2 so as to lubricate mainly the region between the lower edge 4*b* of the cylinder 4 and the piston 2. Due to the rise of the temperature of the refrigerant during compression and the pressure load acting on the top of the piston 2, the demand for lubrication is most critical in the region between the edge 2*b* of the piston and the surface of the cylinder wall. The lateral load exerted by the edge 2*d* of the piston on the mating cylinder wall cannot be reduced to zero, although the axis of the cylinder and the axis of the crankshaft are offset from each other by a distance E as shown in FIG. 6A.

In this embodiment, the suction port 7 is offset towards the end adjacent the edge 2*d* of the piston, so that the region adjacent the edge 2*d* is cooled by the refrigerant of low temperature sucked through the suction port 7 during the suction stroking of the compressor. Meanwhile, the lubricating oil is deposited by surface tension to the region where the projection 2*a* offset from the axis of the piston 2 is connected to the latter, and the depositing lubricating oil is supplied to the end of the piston 2 during compression stroking, thereby preventing occurrence of seizure and, therefore, improving reliability.

As will be understood from the foregoing description, the first to third embodiments provide improved reliability of electrically driven hermetic compressor. The advantages brought about by the described embodiments of the invention are remarkable particularly when these compressors are applied to the following cases:

Fron-type refrigerants have conventionally been used in refrigerators and airconditioner refrigeration systems. For instance, refrigerators usually employ CFC 12, while room airconditioners use HCF 22. Such refrigerants are dissolved in the lubricating oil to lower the viscosity thereof, thus impairing reliability of the sliding portions. The refrigerants of the type mentioned above contain chlorine in their molecules. When the refrigerants are used under severe sliding conditions, the refrigerants are decomposed to generate chlorine which reacts with the surface metal of the sliding portions to produce a compound such as iron chloride, thus forming a compound film. The film of iron chloride has a self-lubricating nature and serves as an extreme-pressure additive to prevent seizure at the sliding portions thereby contributing to improvement in the reliability of the compressor.

In recent years, however, the use of chlorine-containing fron-type refrigerant has been limited by is regulation because of destruction of ozone layer on the earth by freed chlorine, and studies have been made to find chlorine-free substitute refrigerants. HFC 134a is one of such substitute refrigerants. Such substitute refrigerants, however, exhibit a large difference between the discharge pressure and suction pressure when used in a refrigeration cycle, posing severe sliding conditions on the compressor. In addition, the chlorine-free substitute refrigerant has no effect to prevent seizure at the sliding portions because it does not form any self-lubricating film, with the result that the reliability of the compressor is impaired.

The described embodiments of electrically driven hermetic compressor of the present invention can safely operate with such chlorine-free refrigerant, by virtue of the improved lubricating and cooling effects in the sliding regions on the piston, thus enabling the use of the substitute refrigerant such HFC 134a.

Thus, in the third embodiment as described, a scotch-yoke-type mechanism is used to convert rotary motion into reciprocating motion. In this embodiment, the suction port is offset from the axis of the cylinder towards the afore-mentioned edge 2*d* of the piston where the sliding of the piston on the cylinder wall takes place under the greatest pressure, whereas the projection on the piston is offset from the axis of the cylinder in the direction opposite to the suction port, so that the lubrication and cooling is enhanced in the region around the above-mentioned edge of the piston, thus achieving a higher reliability of the compressor.

The effect is particularly advantageous in the case where a substitute refrigerant which has a reduced self-lubricating effect has to be used under regulation for limiting the use of fron-type refrigerant, e.g., when HFC 134a type refrigerant is used in an electrically driven hermetic compressor of a refrigerator.

The advantages described hereinbefore are obtained on the electrically driven hermetic compressor itself. The invention, however, offers the following further advantages when the compressor is used in a system such as a refrigeration cycle for an airconditioner.

Figure 7:
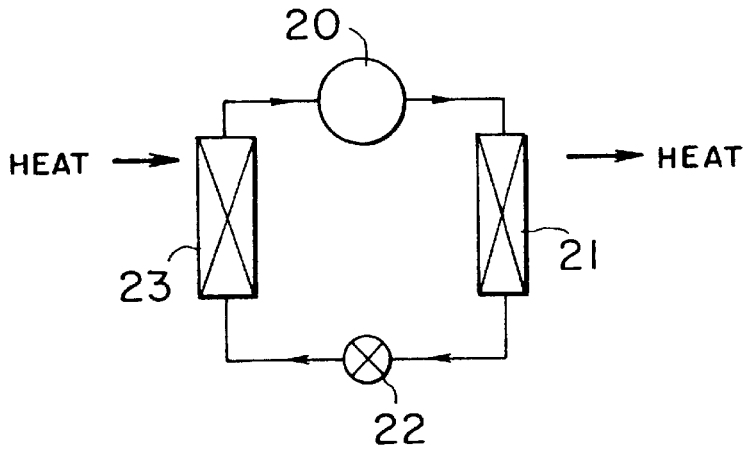
FIG. 7 is a block diagram of a refrigeration cycle, illustrating an example of application of the electrically driven hermetic compressor of the present invention.

FIG. 7 is a block diagram of a refrigeration cycle for a refrigerator or a room airconditioner. This refrigeration cycle incorporates the electrically driven hermetic compressor of the invention which is denoted by 20.

As will be seen from FIG. 7, the refrigeration cycle includes a condenser 21 connected to the outlet of the compressor 20, an orifice mechanism or an expansion valve 22 connected to the outlet side of the condenser 21, and an evaporator 23 connected to the outlet of the expansion valve 22. The outlet end of the evaporator 23 is connected to the suction side of the compressor 20.

The compressor 20 serves to compress a refrigerant gas confined in the refrigeration cycle so as to elevate the pressure and temperature of the refrigerant gas and to circulate the gas. The refrigerant is changed into liquid phase in the condenser 21 as a result of heat exchange with another heat medium flowing through the condenser 21. The refrigerant in its liquid phase is introduced into the expansion valve 22 so as to reduce its pressure and temperature and then is evaporated in the evaporator 23 by absorbing ambient heat so as to be transformed into gaseous phase. The gas is then sucked by the compressor for further compression. Thus, the refrigerant is circulated through the closed loop of the refrigeration cycle while changing its phase from liquid to gas and vice versa. The pressure ratio Pd/Ps of the compressor is therefore determined by the saturation pressures at the temperatures at which the refrigerant is condensed into liquid phase and evaporated into gaseous phase. The compression ratio is as high as 10 to 12 in an ordinary refrigerator which uses CFC 12 as the refrigerant, and is about 3 to 4 in airconditioner refrigerator which uses HFC 134a as the refrigerant. When the afore-mentioned chlorine-free refrigerant HFC 134a meeting the regulation is used in refrigerators, the pressure ratio is further elevated to a range between 11 and 13. As explained before, the advantage of the present invention is remarkable particularly when the compressor of the present invention is used for a system which has large pressure ratio as in the case of the refrigeration cycle described above.

Although preferred embodiments have been separately described, it will be apparent to those skilled in the art that these embodiments may be used independently or in combination so that the advantages of these embodiments are multiplied.

As will be understood from the foregoing description, according to the present invention, it is possible to minimize the dead volume formed in the discharge port by virtue of the projection formed on the top of the piston, while eliminating various limitations posed by the design of the suction and discharge passages and so forth, thus suppressing loss of power and reduction in the capacity attributable to re-expansion of the compressed gas, thus achieving a high efficiency of the electrically driven hermetic compressor.

The compressor of the invention which exhibits improved efficiency by virtue of minimization of dead volume can be used as, for example, a vacuum pump which is required to achieve a specifically high degree of vacuum or as a compressor of a refrigeration cycle which operates with a large difference between suction and discharge pressures as in the cases of refrigerator and room airconditioner.

What is claimed is:

1. An electrically driven hermetic compressor comprising:

a hermetic casing;

an electric motor unit encased in said casing; and a compression mechanism encased by said casing and drivingly connected to said electric motor unit through a crankshaft;

said compression mechanism comprising a cylinder, a piston reciprocatingly slidable in said cylinder, a valve plate having formed therein a suction port and a frustoconical discharge port and providing valve seats ports, suction and discharge valves cooperating with said suction and discharge ports, said cylinder, said piston and said valve plate cooperating to define a compression chamber, a passage system providing separate passages for gas to be compressed and the gas after compression, and a motion converting mechanism for converting rotary motion of said crankshaft into linear reciprocating motion of said piston, wherein said piston is provided with means for preventing said piston from rotating about an axis of said cylinder, and a frustoconical projection is formed on the top of said piston at a point offset from an axis of said piston so as to be received in said frustoconical discharge port formed in said valve plate, with the gradient of the conical surface of said frustoconical projection being smaller than that of said frustoconical discharge port.

2. An electrically driven hermetic compressor according to claim 1, wherein said motion converting mechanism is a scotch-yoke-type mechanism having a slide tube integral with said piston and a slider connected to an eccentric portion of said crankshaft and reciprocatingly slidable in said slide tube, and wherein said suction port formed in said valve plate is offset from the axis of said cylinder towards a pressing portion of an upper edge of said piston which applies pressure to a wall of said cylinder, and said projection on the top of said piston is offset from the axis of said piston in the direction opposite to said pressing portion of said piston.

3. An electrically driven hermetic compressor according to claim 1, wherein said means for preventing piston rotation is provided in said motion converting mechanism which is of a connecting rod type which includes a connecting rod pivotally connected at its one end to an eccentric portion of said crankshaft and at its other end to said piston through a pin mounted on said piston, and wherein said suction port formed in said valve plate is offset from the axis of said cylinder towards a pressing portion of an edge of said piston which applies pressure to the wall of said cylinder, and said projection on the top of said piston is offset from the axis of said piston in the direction opposite to said pressing portion of said piston.

* * * * *